US006719151B2

(12) United States Patent
Close

(10) Patent No.: US 6,719,151 B2
(45) Date of Patent: Apr. 13, 2004

(54) SYSTEM AND METHOD FOR PRODUCT DISPLAY, ARRANGEMENT AND ROTATION

(76) Inventor: James Garth Close, 106 Elderberry St., Georgetown, TX (US) 78628

( * ) Notice: Subject to any disclaimer, the term of this patent is extended or adjusted under 35 U.S.C. 154(b) by 0 days.

(21) Appl. No.: 09/918,843

(22) Filed: Jul. 31, 2001

(65) Prior Publication Data

US 2002/0170197 A1 Nov. 21, 2002

Related U.S. Application Data

(60) Provisional application No. 60/292,441, filed on May 22, 2001, and provisional application No. 60/290,969, filed on May 16, 2001.

(51) Int. Cl.[7] ..... A47F 5/00

(52) U.S. Cl. ..... 211/59.3; 312/71; 211/119.003

(58) Field of Search ..... 211/119.003, 86.01, 211/90.03, 88.01, 90.02, 106; 312/71

(56) References Cited

U.S. PATENT DOCUMENTS 1,702,987 A * 2/1929 Wilson
2,098,844 A * 11/1937 Waxqiser
2,831,598 A * 4/1958 Slavsky et al.
2,980,259 A * 4/1961 Fowlds
3,269,551 A * 8/1966 Hertzel
4,597,616 A * 7/1986 Trubiano
5,411,146 A * 5/1995 Jarecki et al. ..... 211/59.2
5,413,229 A * 5/1995 Zuberbuhler et al. ..... 211/59.3
5,469,976 A * 11/1995 Burchell ..... 211/59.3
6,131,748 A * 10/2000 Kawaski et al. ..... 211/57.1
6,155,438 A * 12/2000 Close ..... 211/59.3
6,227,386 B1 * 5/2001 Close ..... 211/59.3
6,375,015 B1 * 4/2002 Wingate ..... 211/59.3

* cited by examiner

*Primary Examiner*—Robert W. Gibson, Jr.
(74) *Attorney, Agent, or Firm*—Rick B. Yeager

(57) ABSTRACT

A device, system, and method system for manually arranging products on a display shelf without requiring additional shelf width. The product containers, such as jars, cans, and bottles, may be pulled forward toward the front of the display shelf by pulling a front member which is attached to two slide rails which fit into the vacant spaces near the bottom of rounded container sides. In an alternate embodiment, a base is provided to elevate the containers, and the slide rails slide underneath the container. The slide rails are attached to a rear member which engages the rear of the last product container in the row, and pushes the containers forward as the front member is pulled away from the display shelf. The device may be a wire frame which may include side covers of various shapes and sizes.

21 Claims, 8 Drawing Sheets

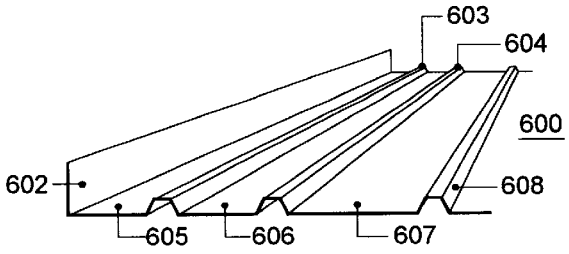
FIG. 13A
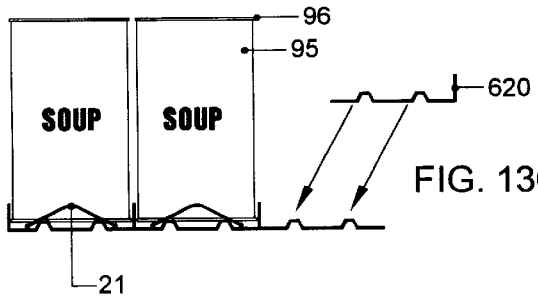
FIG. 13C
FIG. 13B
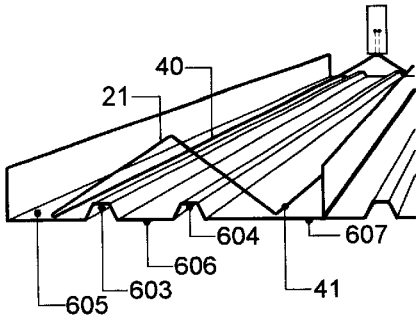
FIG. 13D
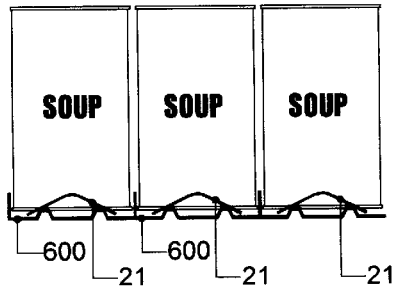
FIG. 13E

SYSTEM AND METHOD FOR PRODUCT DISPLAY, ARRANGEMENT AND ROTATION

RELATED APPLICATIONS

This application is related to provisional patent application No. 60/290,969 filed on May 16, 2001 and to provisional patent application No. 60/292,441 filed on May 22, 2001.

BACKGROUND OF THE INVENTION

1. Field of the Invention

The invention relates to the display, arrangement and rotation of products such as those packaged in bottles, jars, cans, and boxes, and more particularly to an improved product display, arrangement and rotation system and method in which products displayed on a display shelf can easily be arranged or rotated to have the products' expiration dates kept safely up to date and to conveniently position the products manually near the front edge of the shelves for improved visual exposure and effortless selection by consumers.

2. Description of Related Art

Retail stores relying on the consumers to serve themselves have recognized the importance of displaying products near the front edge of display shelves so that the products can be readily seen by consumers and easily reached by the consumers. Customers typically remove products from the front of a display shelf, and products remaining toward the rear of display shelves are often difficult to reach.

Well operated retail stores have clerks move around the store periodically to check the status of goods and to make appropriate corrections by moving products toward the front of display shelves. There is a need to make this alignment process more efficient.

It is also desirable to properly rotate products on a display shelf so that the older products are sold before the newer products. A system for the easy rotation of products is needed to decrease the likelihood that a product will have to be discarded after reaching its expiration date.

The prior art provides some examples of automated or semi-automated shelf display alignment.

U.S. Pat. No. 6,155,438 to applicant describes a system and method for product display, arrangement and rotation. That patent includes a relatively fixed side frame which is typically held in place by magnetic attraction, and a pull frame attached to a rear member that is used to pull product forward on a shelf. That invention is appropriate for containers with straight side walls such as boxes and cans. The current invention is well-suited for containers such as bottles and jars with rounded, or otherwise non-linear side wall profiles.

The '438 patent discusses prior art including U.S. Pat. No. 5,203,463 to Steven K. Gold which teaches the use of springs to push items to the front position on the display shelf; U.S. Pat. No. 5,240,126 to Foster which also uses a ribbon spring arrangement to advance a row of items forward; U.S. Pat. No. 5,240,125 to Kunz, which is similar to the '126 patent, with the addition of a protective wire grid to prevent a glass jar from falling out of the device; and U.S. Pat. No. 5,123,546 to Crum which also uses a spring mechanism.

BRIEF SUMMARY OF THE INVENTION

The invention relates to a device, system and method for displaying and rotating products generally forming a queue on a display surface such as a display shelf.

Some embodiments include two slide rails, one slide rail positioned on either side of a row of product containers. The containers are typically bottles or jars with rounded bottom sides. The slide rails preferably fit within the vacant space left by the rounded lower portion of a row of containers, or within the vacant space left by the lower portions of adjacent rows of containers so as not to take up valuable shelf space. The slide rails are connected to a rear element so that when the slide rails are pulled outward from the display shelf, the rear element engages the queue and pulls the remaining containers toward the front of the display shelf. A front pull element preferably connects the first slide rail with the second slide rail so that the two slide rails may be pulled at the same time and rate by pulling the front pull element.

In one embodiment, the slide rails, the front pull element, and the rear element are formed as a single wire frame. In other embodiments, a plate may serve as the rear element; a cover such as plastic tubing may be placed over the slide rails in order to increase the size of the slide rails in order to help stabilize the product containers; the device may be formed as a single unit, such as by injection molding; or the width between the slide rails may be adjusted.

In some embodiments according to the invention, the slide rail element includes indicia identifying the number of the products in the queue when the positioning element is moved so that the products are substantially aligned with the front portion of the surface. The indicia may also contain information corresponding to the products in the queue. Additionally, the indicia may be a bar code.

Another embodiment according to the invention comprises a temporary shelf basket for receiving products from the surface of the shelf to facilitate the rotation of older products from the rear portion of the surface to the front portion and newer products to the rear portion of the surface. The shelf basket is temporarily attached to the display shelf, preferably by inserting basket support arms into holes located on the display shelf.

A method is provided to use the shelf basket for product rotation by temporarily attaching the basket to the display shelf; removing old product from a row of product display; determining the number of new containers necessary to fill the row; placing the proper number of new containers in the row; removing the old product from the basket and placing the old products in front of the new products in order to fill the row; and removing the shelf basket from the display row.

Another method according to the invention is a method for arranging and displaying products generally forming a queue and taking an inventory, comprising the steps of providing a shelf generally for receiving products to be displayed and having a front and rear portion; providing products having front and rear sides for arrangement and display on the shelf generally in a queue having a front and rear product; and providing an arranging means for placement on the shelf. The arranging means comprises a pair of slide rails, the slide rails defining a channel for receiving the products. The arranging means further has a rear element adapted to engage the rear product in the queue from the rear side of the product, thereby allowing the rear product to be engaged by the rear element for movement from a position in the rear portion to a predetermined position closer to the front portion of the surface. The method further comprises positioning the products in the channel generally in the form of a queue; selectively moving the products manually from the rear portion of the shelf towards the front portion of the shelf by applying a force to the slide rails generally in a direction of the front portion of the shelf, thereby engaging the rear product with the rear element until the first product is located at a predetermined position near the front portion of the shelf; reading the indicia to determine the number of products remaining in the queue; and finally, returning the device to its original position by applying a force on the slide rails generally in a direction of the rear portion of the shelf until the device reaches its original position.

Another embodiment incorporates a product support base with raised tabs to support a row of product containers and to permit the slide rails to slide underneath product containers.

BRIEF DESCRIPTION OF THE SEVERAL VIEWS OF THE DRAWING

FIG. 13A is a perspective view of a divider base unit.

FIG. 13B is an exploded side view of several adjacent divider base units.

FIG. 13C is a side view of adjacent divider base units with can containers.

FIG. 13D is a perspective view of an alignment device placed on a divider base unit.

FIG. 13E is a side view of adjacent divider base units with can containers.

DETAILED DESCRIPTION OF THE INVENTION

Detailed Description of Embodiment—Wire Frame with Slit Side Rail Covers

Figure 1A:
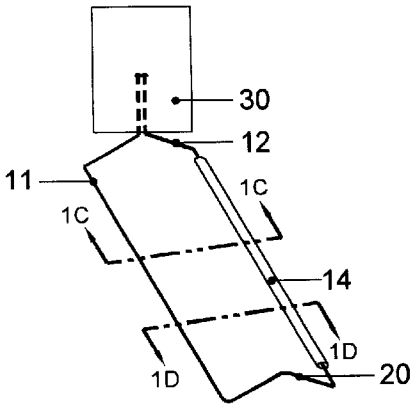
FIG. 1A is a perspective view of a wire frame embodiment of the invention with slip-on tubing covers.

Referring now to FIG. 1A, an embodiment of the current invention is a product display aligning device 10 which is comprised of a wire frame featuring a first side rail 11, a second slide rail 12, a rear pull element 30 affixed to the first and second side rails, and a front pull member 20.

Figure 1B:
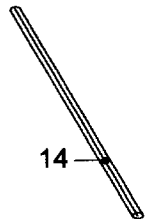
FIG. 1B is a perspective of a slip-on split tubing cover of the embodiment shown in FIG. 1A.

Referring now to FIG. 1B which is a perspective of a slip-on split tubing cover of the embodiment shown in FIG. 1A, the side rails may be covered with a material such as a round slit plastic tubing 14, or they may be left uncovered. In this example, the slit tubing is positioned over each side rail. In other embodiments, the side rail coverings may be installed by other techniques, such as slipping the cover onto the side rail before bending the side rail, or they may be fabricated as a single element without a wire support. The covers may be of various shapes and sizes in order to best fit a particular use as discussed below. In this embodiment, the term slide rail refers to a covered side rail if a cover is installed, and to an uncovered side rail if a cover is not installed prior to use.

Figure 1C:
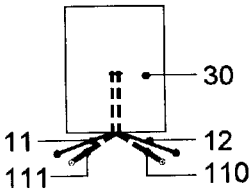
FIG. 1C is a cross sectional view towards the rear element of the embodiment shown in FIG. 1A showing an adjustable width feature of the embodiment.

Referring now to FIG. 1C which is a cross sectional view towards the rear element of the embodiment shown in FIG. 1A, a rear plate 30 is affixed to the side rails 11 and 12 by means of welds 31. Other means of attachment such as positioning the side rails in retaining tabs or channels on the rear element may also be used. One function of the rear element is to engage product containers in order to align those containers on a display shelf. In other embodiments, another function of the rear element is to provide a surface for affixing a label associated with the display product. The rear element may be of various shapes, and in some instances may simply be a bent portion of one or both slide rails. In this embodiment, the side rails 11 and 12 may be bent relative to the rear element in order to narrow or enlarge the distance between the slide rails. For example, the first side rail 11 may be bent to a narrowing position 111, and the second side rail 12 may be bent to a narrowing position 112. This width adjustment feature is useful for adapting the device to various sizes of container bases.

Figure 1D:
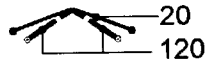
FIG. 1D is a cross sectional view towards the front pull element of the embodiment shown in FIG. 1A showing an adjustable width feature of the embodiment.

Referring now to FIG. 1D which is a cross sectional view towards the front pull element of the embodiment shown in FIG. 1A, in this embodiment, the side rails 11 and 12 are formed from a continuous heavy wire. For example, the wire may be a stainless steel such as ⅛" or thicker wire. The wire may simply be bent in the plane of the slide rails to form a box end, but the wire is typically bent upwards in the form of an inverted "V" in order not to interfere with the visibility of display shelf labeling. In this embodiment, the front pull element may be bent to narrow or enlarge the distance between the side rails as illustrated by a second narrowing position 120.

Figure 1E:
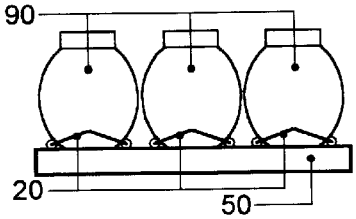
FIG. 1E is a front view of a portion of a display shelf showing product containers and several devices of the embodiment shown in FIG. 1A.

Referring now to FIG. 1E which is a front view of a portion of a display shelf 50 showing product containers 90 and several devices of the embodiment shown in FIG. 1A, the adjacent product containers and alignment devices may be similar as illustrated in this figure, or the devices may be adapted to various shapes and sizes of containers so that the geometry of adjacent devices may be different.

Figure 1F:
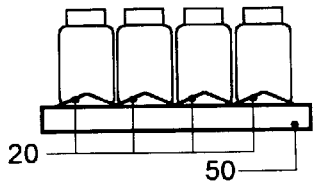
FIG. 1F is a perspective view of a device of the embodiment shown in FIG. 1A used to align containers on a display shelf.

Referring now to FIG. 1F which is a perspective view of a device of the embodiment shown in FIG. 1A used to align containers on a display shelf, a clerk's hand 200 may grasp the front pull element 20 and thereby pull the slide rails 40 and 41 away from the rear of the display shelf. The rear element will engage the rearmost product container 91 and pull the container toward the front of the shelf. The clerk would typically continue pulling until the forward-most product container is properly aligned with the front of the display shelf, and would then push the front pull element back to its original position at the edge of the display shelf.

Detailed Description of Embodiment—Wire Frame Inserted in Rail Covers

Figure 2A:
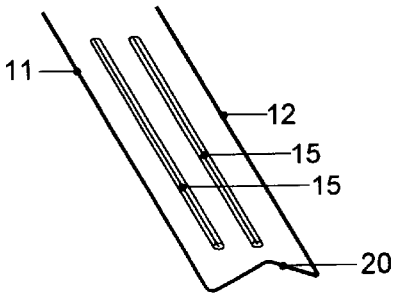
FIG. 2A is an exploded perspective view of an alternative wire frame embodiment of the invention with slip-on tubing covers.

Referring now to FIG. 2A, another embodiment of the current invention is a product display aligning device which is comprised of a wire frame 9 featuring a first side rail 11, a second slide rail 12, and a front pull member 20. In this embodiment, a rear element is not installed until after slide covers 15 are inserted over the side rails.

Figure 2B:
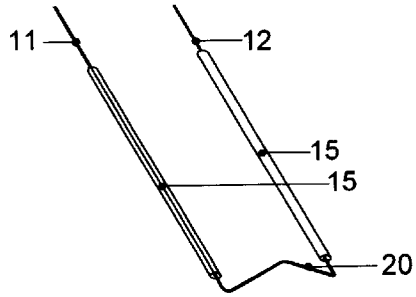
FIG. 2B is a perspective view of the alternative wire frame embodiment of FIG. 2A with tubing covers inserted over the side rails.

Referring now to FIG. 2B which is a perspective view of the alternative wire frame embodiment of FIG. 2A with tubing covers inserted over the side rails, the side rails are partially covered with a material such as a round plastic tubing 15. The covers may be of various shapes and sizes in order to best fit a particular use as discussed below.

Figure 2C:
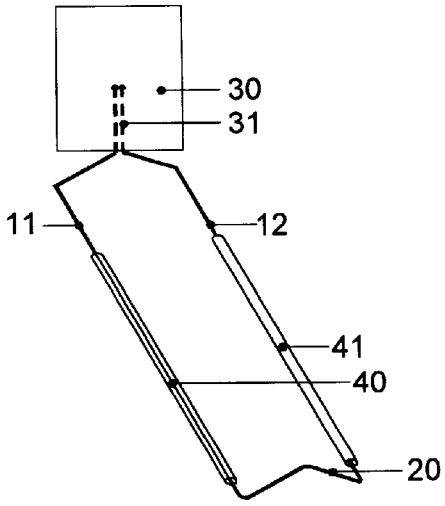
FIG. 2C is a perspective view of the alternative wire frame embodiment of FIG. 2B with a rear element installed.

Referring now to FIG. 2C which is a perspective view of the alternative wire frame embodiment of FIG. 2B with a rear element installed, a rear element 30 is welded or otherwise attached to the side rails. The covered side rails serve as slide rails 40 and 41.

Detailed Description of Embodiment—Wire Rear Member

Figure 3:
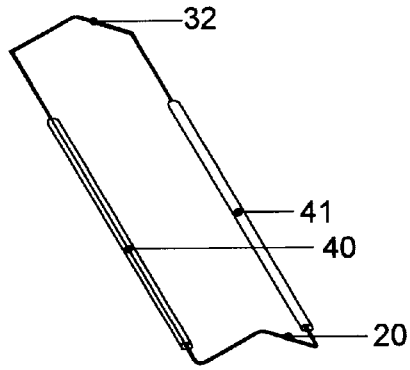
FIG. 3 is a perspective view of an alternative wire frame embodiment without a rear plate element.

Referring now to FIG. 3, another embodiment of the current invention is a product display aligning device which is comprised of a wire frame featuring a first slide rail 40, a second slide rail 41, a front pull member 20, and a bent rear member 32. In this embodiment, the rear element function is provided by the bent wire of the side rails. The wire may be welded or otherwise coupled at any point in the frame, but preferably the wire is either jointed at the bent rear member or in a position along the side rails that is covered. Alternatively, the wire may be left uncoupled, and the cover may serve to hold the wire in proper alignment. In another embodiment, the front pull section 20 and the bent rear member may be two different pieces of wire that are held in position by the side rail covers, so that the front and rear sections are inserted into the covers

Detailed Description of Embodiment—Adjustable Frame Length

Figure 4A:
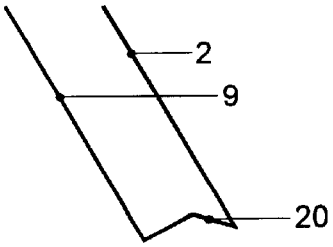
FIG. 4A is an exploded perspective view of another wire frame embodiment of the invention.

Referring now to FIG. 4A, which is an exploded perspective view of another wire frame embodiment of the invention, the wire frame 9 is bent to form the two side rails 11 and 12, and the front pull member 20. The back ends of the side rails are left straight and unattached. A rear member 33 is slipped onto the side rails. The rear member may have a label 35 or other identifying information affixed or printed on it.

Figure 4B:
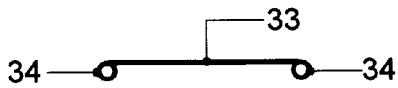
FIG. 4B is a cross sectional view of an alternate rear member with side rail receiving channels.

Referring now to FIG. 4B, which a cross sectional view of an alternate rear member with rail channels, the rear member 33 has a first side rail receiving channel 34*a* and a second side rail receiving channel 34*b* to accept the side rails. This embodiment is particularly useful for specialty items such as baby food.

Figure 4C:
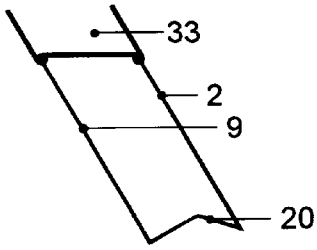
FIG. 4C is a perspective view of the embodiment of FIG. 4A positioned on a display shelf for proper length sizing.

Referring now to FIG. 4C, which is is a perspective view of the embodiment of FIG. 4A positioned on a display shelf for proper length sizing, the device may be sized for proper length on a display shelf by placing the wire frame 9 with the front pull section positioned at the rear of the shelf 50. The side rails 11 and 12 will then overhang the front edge of the display shelf. The rear member 33 is placed on the side rails by inserting each side rail in a side rail receiving channel located on the rear member.

Figure 4D:
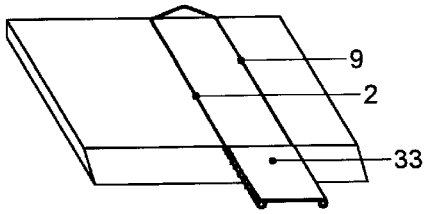
FIG. 4D is a perspective view of the embodiment of FIG. 4A positioned on a display shelf with the rear element being bent to size the length of the device.

Referring now to FIG. 4D which is a a perspective view of the embodiment of FIG. 4A positioned on a display shelf with the rear element being bent to size the length of the device, the rear member may be bent upwards to a second position 133 in order to size the device for the shelf. Optionally, covers may be placed on the side rails before bending the side rails, or slit covers may be placed on the side rails after bending. For smaller product containers, the side rails may serve as slide rails without covers.

Figure 4E:
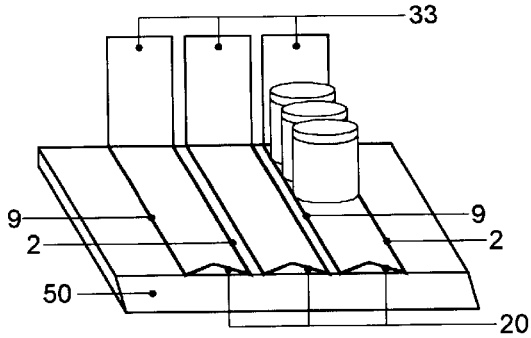
FIG. 4E is a perspective view of a portion of a display shelf showing product containers and several devices of the embodiment shown in FIG. 4A.

Referring now to FIG. 4E which is a perspective view of a portion of a display shelf showing product containers and several devices of the embodiment shown in FIG. 4A, the devices are positioned so that the rear elements 33 are at the rear of the display shelf 50. In the case of small containers 91 such as baby food jars, the containers may be stacked.

Figure 4F:
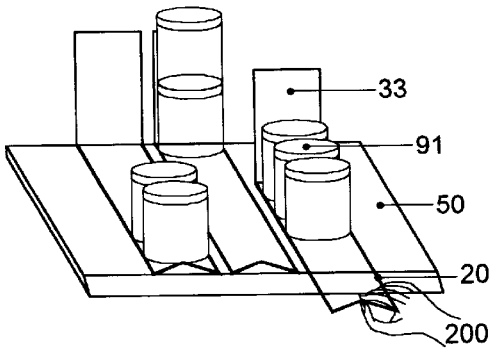
FIG. 4F is a perspective view of a portion of a display shelf showing stacked product containers being aligned with devices of the embodiment shown in FIG. 4A.

Referring now to FIG. 4F which is a perspective view of a portion of a display shelf 50 showing stacked product containers being aligned with devices of the embodiment shown in FIG. 4A, a clerk's hand 200 may grasp the front pull element 20 and pull the slide rails away from the rear of the display shelf. The rear element 33 will engage the rearmost product containers 91 and pull the containers toward the front of the shelf. The clerk would typically continue pulling until the forward-most product container is properly aligned with the front of the display shelf, and would then push the front pull element back to its original position at the edge of the display shelf.

Figure 4G:
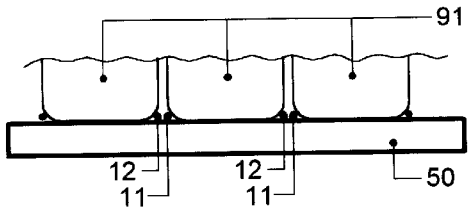
FIG. 4G is a front view of a portion of product containers on a shelf

Referring now to FIG. 4G which is a front view of a portion of product containers on a display shelf 50, the side rails 11 and 12 fit in the spaces created by the rounded bottoms of the containers 91 so that the devices can be installed without requiring additional shelf width.

Detailed Description of Embodiment—Various Slide Rail Shapes and Sizes

Figure 5A:
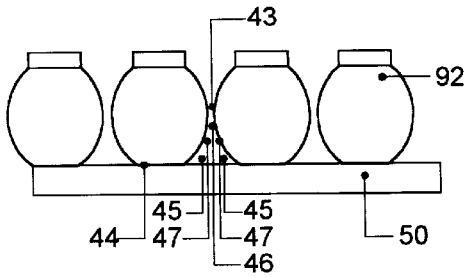
FIG. 5A is a front view of a portion of product containers on a shelf.

Referring now to FIG. 5A which is a front view of a portion of product containers 92 on a shelf 50, the figure illustrates that various shapes of slide rails may be used fit in the vacant spaces created by the bottom portions of the product containers. The slide rails may be round 15, or polygonal such as the rectangular 16 or generally triangular 17 elements as shown. The slide rails may be of single piece construction such as plastic extrusions, or they may be in the form of covers which are positioned on a wire frame.

Figure 5B:
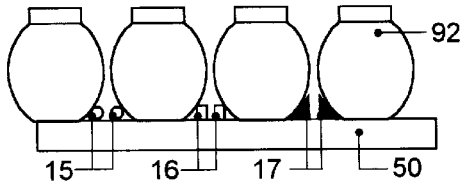
FIG. 5B is a front view of a portion of product containers on a shelf illustrating the vacant space at the base of the containers.

Referring now to FIG. 5B which is a front view of a portion of product containers on a shelf illustrating the vacant space at the base of the containers, the widest part of the containers 92 is shown as point 43 along the side wall of the containers. The base of the containers is shown as 44. The area between the lower portion of the side wall 47 and a line 46 tangent to the widest point 43 of the container and perpendicular to the display shelf 50 defines a vacant cross sectional area for the preferred positioning of the slide rails. Depending upon the height and mass of the container, it is desirable to select a slide rail geometry and size that will fit substantially within the vacant space so as not to take up additional shelf width, but which will also assist in stabilizing the containers when they are moved.

The slide rails may include markings or indicia for indicating the number of products in the queue, or the number of products necessary to fill a queue.

Detailed Description of Embodiment—Extruded Slide Rails

Figure 6A:
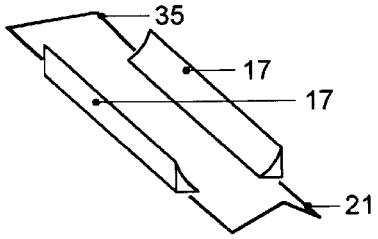
FIG. 6A is an exploded perspective view of another embodiment of the invention.

Referring now to FIG. 6A which is an exploded perspective view of another embodiment of the invention, the slide rails may be extruded, or otherwise fabricated, such as the generally triangular sections 17 shown, and the front pull section 21 and the rear member may be insertable into the slide rails.

Figure 6B:
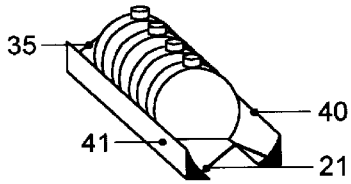
FIG. 6B is a perspective view of the embodiment of FIG. 6A positioned on a display shelf with product containers.

Referring now to FIG. 6B which is a perspective view of the embodiment of FIG. 6A positioned on a display shelf 50 with product containers 92, the slide rails 40 and 41 are the extruded sections, and the rear member 35 and the front pull member 21 have been inserted into the slide rails.

Figure 6C:
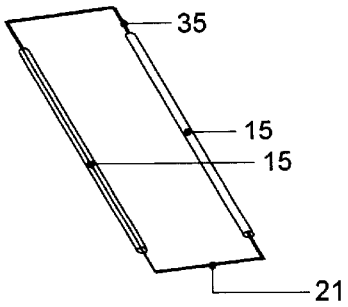
FIG. 6C is a perspective view of another cover for the embodiment of FIG. 6A.

Referring now to FIG. 6C which is a perspective view of another cover for the invention of FIG. 6A, the front pull element 21 and the rear element 35 are inserted into round covers 15.

Figure 6D:
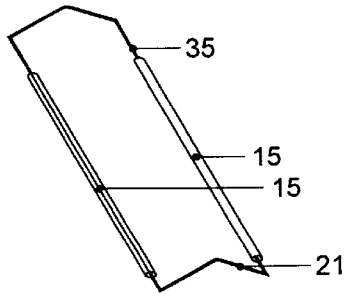
FIG. 6D is a perspective view of the embodiment of FIG. 6*c* with the width of the device narrowed by bending the rear element and the front pull element.

Referring now to FIG. 6D which is a perspective view of the embodiment of FIG. 6C, the width of the device may be narrowed by bending the rear element 35 and the front pull element 21. In this manner, the device may be adapted to various sizes of containers.

Detailed Description of Embodiment—Bent Wire Rear Member

Figure 7A:
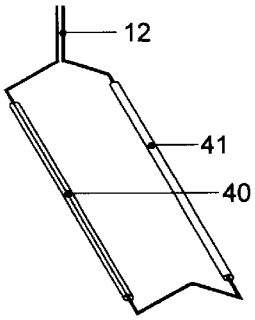
FIG. 7A is a perspective view of an embodiment having unconnected bent wire as the rear member.

Referring now to FIG. 7A which is a perspective view of an embodiment having unconnected bent wire as the rear member, the side rails 11 and 12 may be bent inward to function as a rear member without a plate or other connecting device.

Figure 7B:
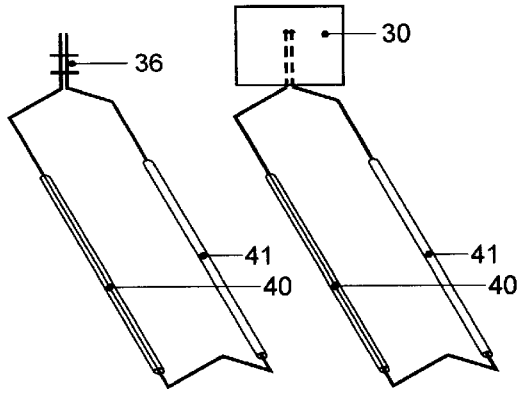
FIG. 7B is a perspective view of an embodiment having welded wires as the rear member.

Referring now to FIG. 7B which is a perspective view of an embodiment having welded wires as the rear member, one or more wire elements 36 may be welded or otherwise secured to the side rails 11 and 12 in order to hold the side rails in position and to form a rear member.

Detailed Description of Embodiment—Extruded Unit

Figure 8:
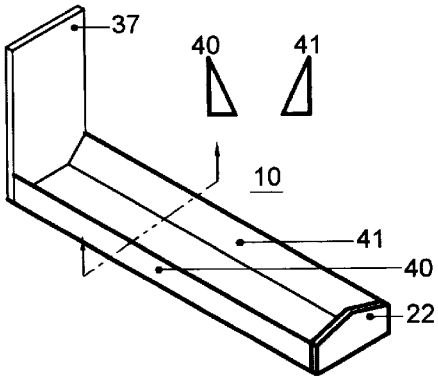
FIG. 8 is a perspective view of an embodiment with molded or extruded elements.
Figure 8:
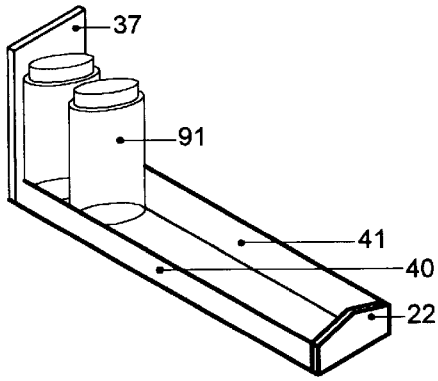

Referring now to FIG. 8 which is a perspective view of an embodiment with molded or extruded elements, the entire arranging unit 10 may be produced by injection molding. This technique is useful for common slide rail sizes and shelf widths. Alternately, the slide rails 40 and 41, the rear element plate 37, and the front pull element 22 may be molded seperately and assembled; the slide rails and front pull element may be formed as a first unit and then attached to a rear element plate; or the slide rails and rear element plate may be formed as a first unit and then attached to a front pull element.

Detailed Description of Embodiment—Alignment Method

Figure 9:
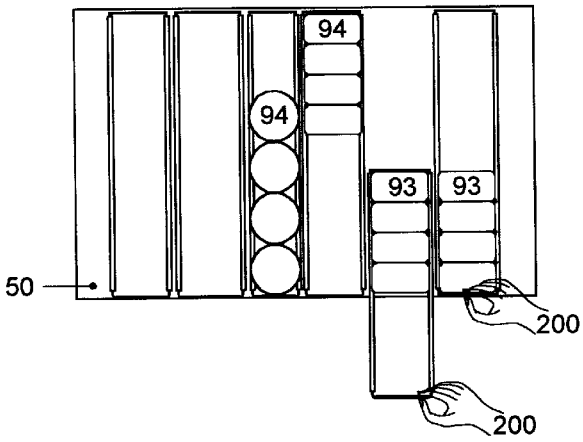
FIG. 9 is a top view of several devices in position on a display shelf illustrating the use of the device in aligning product containers.

Referring now to FIG. 9 which is a top view of several devices in position on a display shelf, reference 201 shows a first size of device with no products in the row; reference 202 shows a second size of device with no products in the row; reference 203 shows the first size of device with products 94 properly displayed toward the front of the display shelf; reference 204 shows the second size of device with products 93 remaining toward the rear of the display and with empty shelf space in front of the products where products have been removed; reference 205 shows a clerks hand 200 having pulled the device to align the products of element 204 toward the front of the display shelf; and reference 206 shows a clerks hand 200 having pushed the device back into position after aligning the products toward the front of the display shelf.

Detailed Description of Embodiment—Rear Element for Stackable Containers

Figure 10A:
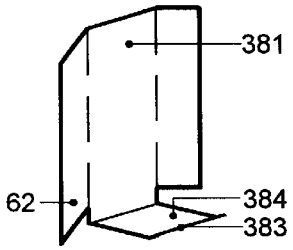
FIG. 10A is a perspective view of an accessory rear element for stacked containers.

Referring now to FIG. 10A which is a perspective view of an accessory rear element for stacked containers, the rear element 38 is designed to fit between the channel between the first slide rail and the second slide rail in order to support stacked containers. In this example, the rear element is comprised of a rear support 381, side supports 382, a base 384, and a front lip 383.

Figure 10B:
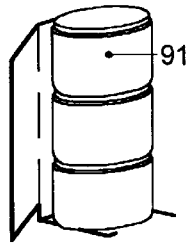
FIG. 10*b* is a perspective view of the embodiment of FIG. 10A showing stacked containers.

Referring now to FIG. 10B which is a perspective view of a the embodiment of FIG. 10A showing stacked containers 91, the rear element supports the rearmost stack of containers as the stack is moved into alignment. Once the containers are aligned, the front pull member may be pushed back into position, and the accessory rear element will remain with the rear product stack in the row. The accessory rear element supports a stacked row as it is moved into alignment.

Figure 10C:
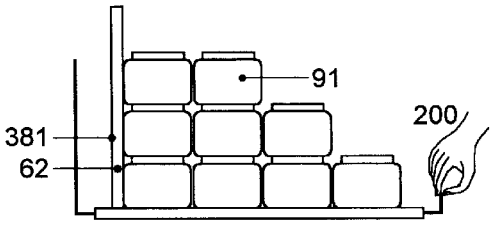
FIG. 10C is a side view of stacked containers with the rear element of FIG. 10A.

Referring now to FIG. 10C which is a side view of stacked containers with the rear element of FIG. 10A, a clerk's hand 200 may grasp the pull unit to engage the rear support 381 in order to pull the stacks of containers 91 forward.

Detailed Description of Embodiment—Product Support Basket

Figure 11A:
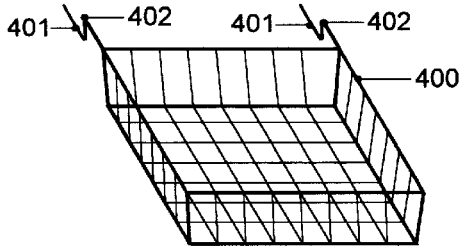
FIG. 11A is a perspective view of a basket to assist in restocking for product rotation.

Referring now to FIG. 11A which is a perspective view of a basket to assist in restocking for product rotation, the basket 400 is designed with support arms 401 which can be inserted into holes in the display shelf in order to support the basket and its contents. The support arms each preferably include a bend 402 which engages a hole in the display shelf. The display shelf is typically perforated on the front edge with a plurality of holes. The basket is typically of welded wire construction.

Figure 11B:
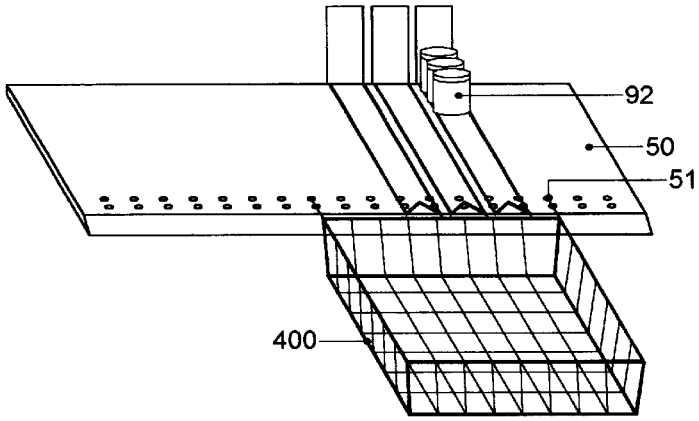
FIG. 11*b* is a perspective view of a basket positioned on a display shelf.

Referring now to FIG. 11B which is a perspective view of a basket positioned on a display shelf, the basket 400 has been positioned adjacent to a row of product containers 92. The basket is held in place by inserting the support arms into holes 51 on the display shelf 50. The basket is typically used to hold product containers from a shelf while new containers are placed in the rear of the row according to proper rotation. For example, the product row illustrated has 4 containers, and a full row would hold 9 containers. The four containers may be removed by pulling the front pull element and bringing the product containers to the front of the shelf. The four containers would be placed in the basket, and five new containers would be inserted in the row by placing a container at the front of the row and pushing it backwards toward the rear of the shelf. The slide rails 40 and 41 help to align the product as it is being pushed backward. After the five new containers are placed in the row, the four old containers are removed from the basket and placed in the row in front of the new containers. The entire row can be aligned, if necessary, by pulling the pull element.

Detailed Description of Embodiment—Rotational Alignment Base

Figure 12A:
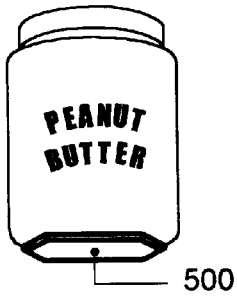
FIG. 12A is a perspective bottom view of a container base to inhibit container rotation.

Referring now to FIG. 12A which is a perspective bottom view of a device to inhibit container rotation, a product container may be formed with a polygonal base 500 which can inhibit rotation of the container when the container is placed in a display alignment device. The side walls of the polygonal base are preferably in or near contact with the slide rails, and the slide rails prevent the product base 500 from rotating when the slide rails are pulled forward.

Figure 12B:
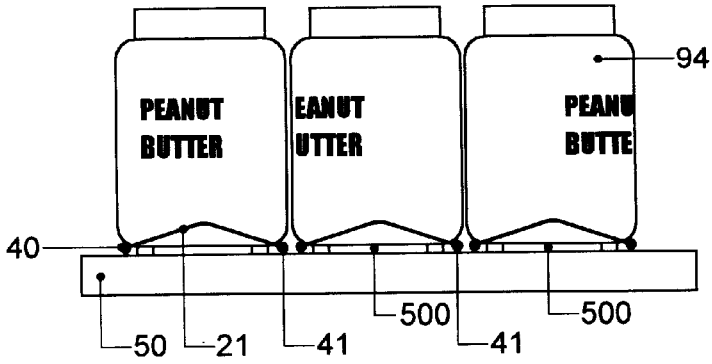
FIG. 12B is a side view of devices of FIG. 12A attached to the bottoms of containers.

Referring now to FIG. 12B which is a side view of devices of FIG. 12A attached to the bottoms of containers, the base 500 is positioned between the slide rails 40 and 41 in order to prevent the container from rotating as it is moved on the display shelf.

Figure 12C:
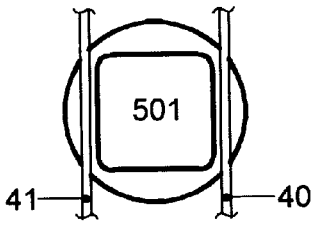
FIG. 12C is a bottom view of a container base of FIG. 12A.

Referring now to FIG. 12C which is a bottom view of a container base of FIG. 12A, the base 500 fits between the slide rails 40 and 41. The base may either be touching the slide rails, or there may be a gap between the base and the slide rails.

Figure 12D:
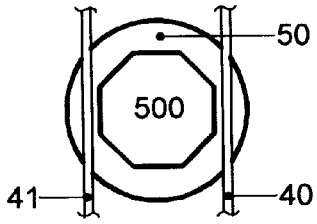
FIG. 12D is a bottom view of a container base with a rectangular base.

Referring now to FIG. 12D which is a is a bottom view of a container base with a rectangular base 501, the base may be rectangular.

Detailed Description of Embodiment—Divider Support Base

Referring now to FIG. 13A which is a perspective view of a divider base unit, it is desirable with some products such as soup cans, to provide a product alignment means which can align product on a display shelf without taking additional shelf width. Containers such as soup cans, toppings, and Vienna sausages are well-suited to this embodiment. Soup cans, for instance, typically have a 0.005 inch thick rim at the top of the cans for the purpose of stabilizing a stack of cans. A base unit 600 as illustrated in FIG. 13A is designed to fit within the small gap between the bottom portions of adjacent rows of cans. The unit includes a vertical lip 602 that serves as a divider between rows of containers.

Referring now to FIG. 13B which is an exploded side view of several adjacent divider base units, another rib 608 is preferably located so that the first rib 603 of a second base unit can fit over the rib to create a channel for a particular size container.

Referring now to FIG. 13C which is an is a side view of adjacent divider base units with can containers, the stacking of base units may continue for as many rows as desired, and an end unit 620 may be placed as a last unit to form the last channel.

Referring now to FIG. 13D which is a perspective view of an alignment device placed on a divider base unit, ribs 603 and 604, which are typically 5/32" high, support the containers above flat areas of the base 605, 606, and 607. A product alignment device, such as a 1/8" wire pull frame can be positioned on the flat areas 605 and 607, so that the slide rails 40 and 41 may move on those surfaces underneath the containers positioned on the ribs 603 and 604.

Referring now to FIG. 13E which is a side view of adjacent divider base units with can containers, the can containers 95 may be placed in the channels formed by the base units. The front pull member 21 of the alignment device can be used to align the products to the front of the display shelf.

What is claimed is:

1. A product alignment device for use in manually aligning product containers on a display shelf, the product alignment device comprising:

an elongated first side member having a front and a rear, such that the first side member may rest on the display shelf and may be pushed and pulled along a plane parallel to the display shelf, such that the first side member is comprised of an elongated inner wire member first portion, and a second cover portion which substantially surrounds the inner wire member;

an elongated second side member having a front and a rear, such that the second side member may rest on the display shelf and may be pushed and pulled along a plane parallel to the display shelf, such that the second side member is comprised of an elongated inner wire member first portion, and a second cover portion which substantially surrounds the inner wire member; and a rear member integral to the rear of the first side member and integral to the rear of the second side member, such that the rear member may be pushed and pulled along a plane parallel to the display shelf by pushing and pulling the first side member and the second side member.

2. The product alignment device of claim 1 wherein:

the second cover portion of the first side member is slotted so that the second cover portion may be inserted over the inner wire member first portion; and the second cover portion of the second side member is slotted so that the second cover portion may be inserted over the inner wire member first portion.

3. The product alignment device of claim 1 wherein:

at least one of the second cover portion of the first side member and the second cover portion of the second side member has a round cross section.

4. The product alignment device of claim 1 wherein:

at least one of the second cover portion of the first side member and the second cover portion of the second side member has a rectangular cross section.

5. The product alignment device of claim 1 wherein:

at least one of the second cover portion of the first side member and the second cover portion of the second side member has a polygonal cross section.

6. The product alignment device of claim 1 wherein:

at least one of the second cover portion of the first side member and the second cover portion of the second side member has a generally triangular cross section.

7. A product alignment device for use in manually aligning product containers on a display shelf, the product alignment device comprising:

an elongated first side member having a front and a rear, such that the first side member may rest on the display shelf and may be pushed and pulled along a plane parallel to the display shelf;

an elongated second side member having a front and a rear, such that the second side member may rest on the display shelf and may be pushed and pulled along a plane parallel to the display shelf; and a rear member integral to the rear of the first side member and integral to the rear of the second side member, such that the rear member may be pushed and pulled along a plane parallel to the display shelf by pushing and pulling the first side member and the second side member, such that there is a first wire segment having a first portion serving as at least a portion of the first side member, and a second portion bent relative to the rear of the first side section;

there is a second wire segment having a first portion serving as at least a portion of the second side member, and a second portion bent relative to rear of the first side section; and the rear member includes a first channel for receiving the second portion of the first wire segment, and includes a second channel for receiving the second portion of the second wire segment.

8. The product alignment device of claim 7 wherein the rear member further comprises a rear stack support, the rear stack support comprising a base for receiving one or more stacked containers, a rear vertical wall integral to the base to support a stack of containers, the rear wall having a side wings along its vertical edges, and a front lip integral to the base, such that the rear stack support may be placed in front of the rear member in order to support the rearmost stack of containers in a row of stacked containers.

9. The product alignment device of claim 7 further comprising at least one divider support base placed on the display shelf and under the first and second slide rails, the divider support base comprising a base, such that the slide rails may be pushed and pulled on top of the base, and a plurality of support ribs, such that height of the support ribs is greater than the height of the slide rails, so that the slide rails may be moved underneath the base of containers which are placed on the support ribs.

10. The product alignment device of claim 9 wherein the divider support base further comprises at least one divider wall.

11. The product alignment device of claim 10 comprising a first divider support base having a first support rib, a second support rib, a divider wall, and an alignment rib; and a second divider support base having a first support rib, a second support rib, and a divider wall, such that the first support rib of the second divider support base engages the alignment rib of the first divider support base, thereby forming a channel of desired width between the first divider support base divider wall and the second divider support base divider wall.

12. A method for arranging products to be displayed, comprising the steps of:

providing a display shelf with first products arranged in a queue, the display shelf having a front and rear portion;

providing second products to be displayed on the display shelf in the queue;

providing a shelf basket capable of being positioned on a display shelf so that the first products can be moved into the shelf basket with a smooth transition;

positioning the shelf basket so that it is positioned to receive the first products;

moving the first products from the shelf onto the shelf basket;

moving the second products onto the shelf basket;

positioning the second products towards the rear portion of the display shelf; and moving the first products from the shelf basket onto the display shelf generally in front of the second products.

13. The method as claimed in claim 12, wherein the number of second products and the number of first products positioned in the queue substantially fill the queue.

14. A method for rotating product containers in a queue on a display shelf, comprising:

placing an arranging means on the display shelf, the arranging means comprising a rear positioning element adapted to engage the rear product container in the queue from the rear side of the product, a front pull element, a first slide rail, such that the rear of the first slide rail is connected to the rear positioning element, and the front of the first slide rail is connected to the front pull element, and a second slide rail, such that the rear of the second slide rail is connected to the positioning element, and the front of the second side slide rail is connected to the front pull element, such that the first slide rail and the second slide rail are spaced apart to define a channel to receive the product containers on the display shelf;

placing at least one old product container in the channel;

positioning a shelf basket on a shelf located within reach of the queue;

pulling the front pull element away from the display shelf and thereby pulling the first and second slide rails and the rear positioning element outwardly with respect to the display shelf, thereby engaging the rearmost product container and pulling all old product containers located in the channel toward the front of the shelf;

removing all old product containers from the channel;

determining the number of new product containers necessary to fill the queue;

inserting the proper number of new containers in the channel;

pushing the new containers toward the rear of the channel;

removing the old containers from the shelf basket and placing the old containers in the channel in front of the new containers; and pushing the front pull element back toward the rear of the display shelf after the product containers are properly aligned with respect to the front of the display shelf.

15. A system for displaying products generally forming a queue on a display shelf, the system comprising:

a product display shelf having a front portion and a rear portion;

at least one product container, the container having a bottom which rests on the display shelf, a preferred front face, a first side face having a lower first side face portion, and a second side face having a lower second side face portion, such the lower first side face portion is not orthogonal to the display shelf, and the lower second side face portion is not orthogonal to the display shelf; and an arranging means operable for moving at least one product container manually from the rear portion of the display shelf towards the front portion of the display shelf, the arranging means comprising a rear positioning element adapted to engage the rear product container in the queue from the rear side of the product, a front pull element, a first slide rail, such that the rear of the first slide rail is connected to the rear positioning element, and the front of the first slide rail is connected to the front pull element, and a second slide rail, such that the rear of the second slide rail is connected to the positioning element, and the front of the second side slide rail is connected to the front pull element, such that the first slide rail and the second slide rail are spaced apart to define a channel to receive the product containers on the display shelf, such that the front pull element may be pulled outwardly from the display shelf in order to pull the first and second slide rails and the rear positioning element outwardly with respect to the shelf, thereby engaging the rearmost product container and pulling all product containers located in the channel toward the front of the shelf, and such that the front pull element may be pushed back toward the rear of the display shelf after the product containers are properly aligned with respect to the front of the display shelf, and such that the product container comprises a first edge in proximity to the first slide rail, and a second edge in proximity to the second slide rail, the first slide rail is positioned below the outermost point of the first edge, and the second slide rail is positioned below the outermost point of the second edge.

16. The system as claimed in claim 15, further comprising a temporary shelf basket for extending to receive products from the display shelf to facilitate the rotation of older products from the rear portion of the display shelf to the front portion and newer products to the rear portion of the display shelf; the shelf basket comprising means to engage the display shelf for maintaining the shelf basket in a predetermined position.

17. The system as claimed in claim 15, further comprising at least one divider support base placed on the display shelf and under the first and second slide rails, the divider support base comprising a base, such that the slide rails may be pushed and pulled on top of the base, and a plurality of support ribs, such that height of the support ribs is greater than the height of the slide rails, so that the slide rails may be moved underneath the base of containers which are placed on the support ribs.

18. The system as claimed in claim 15, further comprising a rear stack support, the rear stack support comprising a base for receiving one or more stacked containers, a rear vertical wall integral to the base to support a stack of containers, the rear wall having a side wings along its vertical edges, and a front lip integral to the base, such that the rear stack support may be placed in front of the rear positioning element in order to support the rearmost stack of containers in a row.

19. A method for aligning product containers in a queue on a display shelf, comprising:

placing an arranging means on the display shelf, the arranging means comprising a rear positioning element adapted to engage the rear product container in the queue from the rear side of the product, a front pull element, a first slide rail, such that the rear of the first slide rail is connected to the rear positioning element, and the front of the first slide rail is connected to the front pull element, and a second slide rail, such that the rear of the second slide rail is connected to the positioning element, and the front of the second side slide rail is connected to the front pull element, such that the first slide rail and the second slide rail are spaced apart to define a channel to receive the product containers on the display shelf;

placing at least one product container in the channel, such that the product container comprises a first edge in proximity to the first slide rail, and a second edge in proximity to the second slide rail, and such that the first slide rail is positioned below the outermost point of the first edge; and the second slide rail is positioned below the outermost point of the second edge;

pulling the front pull element away from the display shelf and thereby pulling the first and second slide rails and the rear positioning element outwardly with respect to the display shelf, thereby engaging the rearmost product container and pulling all product containers located in the channel toward the front of the shelf; and pushing the front pull element back toward the rear of the display shelf after the product containers are properly aligned with respect to the front of the display shelf.

20. The method as claimed in claim 19, wherein placing the arranging means on the display shelf comprises:

placing the arranging means on a divider support base, the divider support base comprising a base, such that the slide rails may be moved along the base, and a plurality of support ribs, such that height of the support ribs is greater than the height of the slide rails, so that the slide rails may be moved underneath the base of containers placed on the support ribs.

21. A product alignment device for use in aligning and positioning a product on a display shelf, the product alignment device comprising:

a wire frame, the wire frame comprising an elongated first frame side having a front and a rear, an elongated second frame side having a front and a rear, a rear portion connecting the first frame side and the second frame side, and a front portion connecting the first frame side and the second frame side;

a first frame side covering which substantially surrounds the elongated first frame side; and a second frame side covering which substantially surrounds the elongated second frame side.

* * * * *